US008028757B2

(12) United States Patent
Candito et al.

(10) Patent No.: US 8,028,757 B2
(45) Date of Patent: Oct. 4, 2011

(54) NOZZLE FOR EXTINGUISHING DEVICES AND THE LIKE

(75) Inventors: Fabio Bruno Candito, Bologna (IT); Andrea Amadesi, Bologna (IT)

(73) Assignee: Firet Italia S.R.L., Zola Predrosa (IT)

( * ) Notice: Subject to any disclaimer, the term of this patent is extended or adjusted under 35 U.S.C. 154(b) by 209 days.

(21) Appl. No.: 11/499,799

(22) Filed: Aug. 7, 2006

(65) Prior Publication Data

US 2007/0034388 A1 Feb. 15, 2007

(30) Foreign Application Priority Data

Aug. 10, 2005 (IT) ..... BO2005A0535

(51) Int. Cl.
*A62C 37/08* (2006.01)

(52) U.S. Cl. ..... 169/37; 169/42

(58) Field of Classification Search ..... 239/589, 239/601, 569, 570, DIG. 19; 169/30, 71, 169/72, 75, 37, 42
See application file for complete search history.

(56) References Cited

U.S. PATENT DOCUMENTS

| | | | | |
|---|---|---|---|---|
| 3,664,430 | A * | 5/1972 | Sitabkhan | 169/23 |
| 3,756,321 | A * | 9/1973 | Gloeckler | 169/40 |
| 3,810,511 | A * | 5/1974 | James | 169/37 |
| 4,253,527 | A * | 3/1981 | Wilhoit | 169/57 |
| 4,976,320 | A * | 12/1990 | Polan | 169/39 |
| 5,036,923 | A | 8/1991 | Shea, Sr. | |
| 5,094,298 | A * | 3/1992 | Polan | 169/41 |
| 5,129,386 | A * | 7/1992 | Meister | 126/299 R |
| 5,458,201 | A * | 10/1995 | Brim | 169/26 |
| 6,155,815 | A * | 12/2000 | Crandell | 425/549 |
| 6,158,522 | A * | 12/2000 | Laderoute | 169/46 |
| 6,182,768 | B1 * | 2/2001 | Andersson | 169/74 |

FOREIGN PATENT DOCUMENTS

| | | | |
|---|---|---|---|
| EP | 0 138 195 | A2 | 4/1985 |
| EP | 0 930 454 | A1 | 7/1999 |
| GB | 541 467 | A | 11/1941 |
| GB | 2 021 408 | A | 12/1979 |
| WO | WO 03/105963 | A | 12/2003 |
| WO | WO 2004/038826 | A | 5/2004 |
| WO | WO 2004/096370 | A | 11/2004 |

* cited by examiner

*Primary Examiner* — Davis Hwu

(74) *Attorney, Agent, or Firm* — Cesari and McKenna, LLP

(57) ABSTRACT

A nozzle for extinguishing devices and the like, made of a material with a high heat conductivity coefficient and comprising at least one through opening, at least one portion of which is blocked hermetically by at least one pad made of thermoplastic material, the pad being automatically removable, due to the pressure of the extinguishing agent, at a preset temperature, so as to allow the automatic dispensing of the extinguishing agent.

21 Claims, 2 Drawing Sheets

NOZZLE FOR EXTINGUISHING DEVICES AND THE LIKE

The present invention relates to a nozzle for extinguishing devices and the like.

BACKGROUND OF THE INVENTION

In the fire-fighting sector, extinguishing devices of the automatic type, such as fire extinguishers, fire-fighting systems and the like, are known which are provided with nozzles which, in case of fire in the controlled environment, allow automatic dispensing of the extinguishing agent without requiring the presence of the operator.

In the particular sector, the general trend is to provide automatic extinguishing devices which are assuredly effective and allow quick maintenance and restoring of the nozzles following activation.

SUMMARY OF THE INVENTION

The aim of the present invention is to meet the mentioned requirements, by providing a nozzle for extinguishing devices and the like which is assuredly effective and is simple to maintain and restore.

Within this aim, an object of the invention is to provide a nozzle which, by way of its particular constructive characteristics, is capable of giving the greatest assurances of reliability and safety in use.

Another object of the present invention is to provide a nozzle which is simple, relatively easy to provide in practice, effective in operation, and further competitive from an economic standpoint.

This aim and these and other objects that will become better apparent hereinafter are achieved by a nozzle for extinguishing devices and the like, characterized in that it is made of a material with a high heat conductivity coefficient and comprises at least one through opening, at least one portion of which is blocked hermetically by at least one pad made of thermoplastic material, said pad being automatically removable, due to the pressure of the extinguishing agent, at a preset temperature, so as to allow the automatic dispensing of the extinguishing agent.

BRIEF DESCRIPTION OF THE DRAWINGS

Further characteristics and advantages of the invention will become better apparent from the following detailed description of some non-exclusive embodiments of a nozzle according to the invention, illustrated by way of non-limiting example in the accompanying drawings, wherein.

DESCRIPTION OF THE PREFERRED EMBODIMENTS

Figure 1:
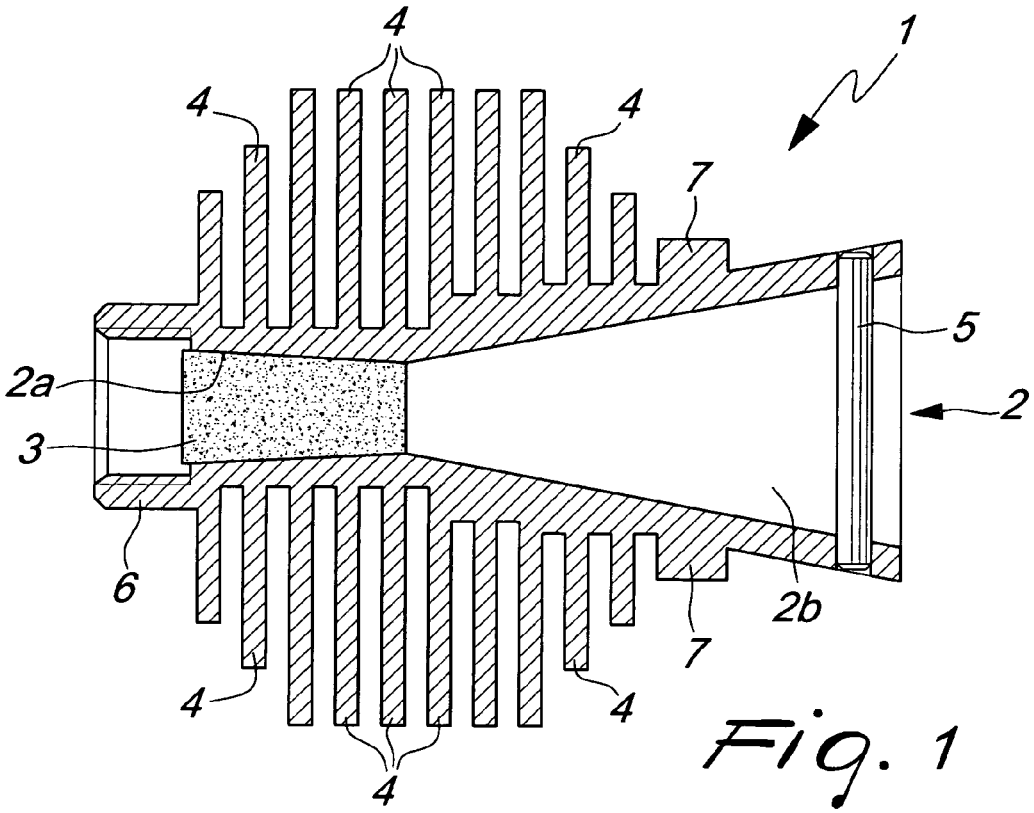
FIG. 1 is a sectional side elevation view of a first embodiment of a nozzle for extinguishing devices and the like according to the invention.

With reference to the figures, the reference numeral 1 generally designates a nozzle according to the invention, which is associated with an extinguisher E.

It should be noted that the nozzle 1 can be associated with any extinguishing device and therefore with extinguishers, fire-fighting systems, and the like.

The nozzle 1 is made of a material with a high heat conductivity coefficient and comprises a through opening 2, at least one portion of which is blocked hermetically by a pad 3 made of thermoplastic material, which is automatically removable due to the pressure of the extinguishing agent at a predefined temperature, so as to allow automatic dispensing of said extinguishing agent.

In a first embodiment, the nozzle 1 is advantageously of the De Laval type, and the opening 2 comprises in succession, along the direction of expulsion of the extinguishing agent, a converging part 2*a* and a diverging part 2*b*.

Conveniently, the converging part 2*a* is blocked hermetically by the pad 3, which is shaped complementarily with respect to said part; the pad 3 is provided for example by pouring into the converging part 2*a* the thermoplastic material, which is conveniently heated, in the fluid state: once the part 2*a* has been filled, the material is cooled and the solidified pad 3 allows its hermetic closure. Positively, with the extinguishing device in the operating configuration, the pressure applied by the extinguishing agent also keeps the pad 3 pressed hermetically against the walls of the converging part 2*a*.

The extinguishing agent is preferably constituted by a suitable gas such as nitrogen, carbon dioxide, halon and others.

Favorably, the nozzle 1 comprises heat conduction means, constituted preferably by a plurality of fins 4 which are distributed peripherally thereto, so as to follow rapidly the abnormal temperature variations caused by the onset of a fire in the environment controlled by the extinguishing device.

The nozzle 1 can comprise a security element which is adapted to prevent the violent expulsion, at high speed, of the pad 3, which is constituted for example by a pin 5 which is inserted detachably in at least one respective hole of the nozzle 1 and is arranged transversely to the diverging part 2*b*, so as to block the pad 3.

Conveniently, the nozzle 1 comprises an end shank 6 for coupling to outlets of the extinguishing devices and further comprises advantageously a contoured portion 7, which is shaped for example like a hexagonal nut and is adapted to be gripped by a tool so as to allow optimum fastening to said outlets.

Figure 2:
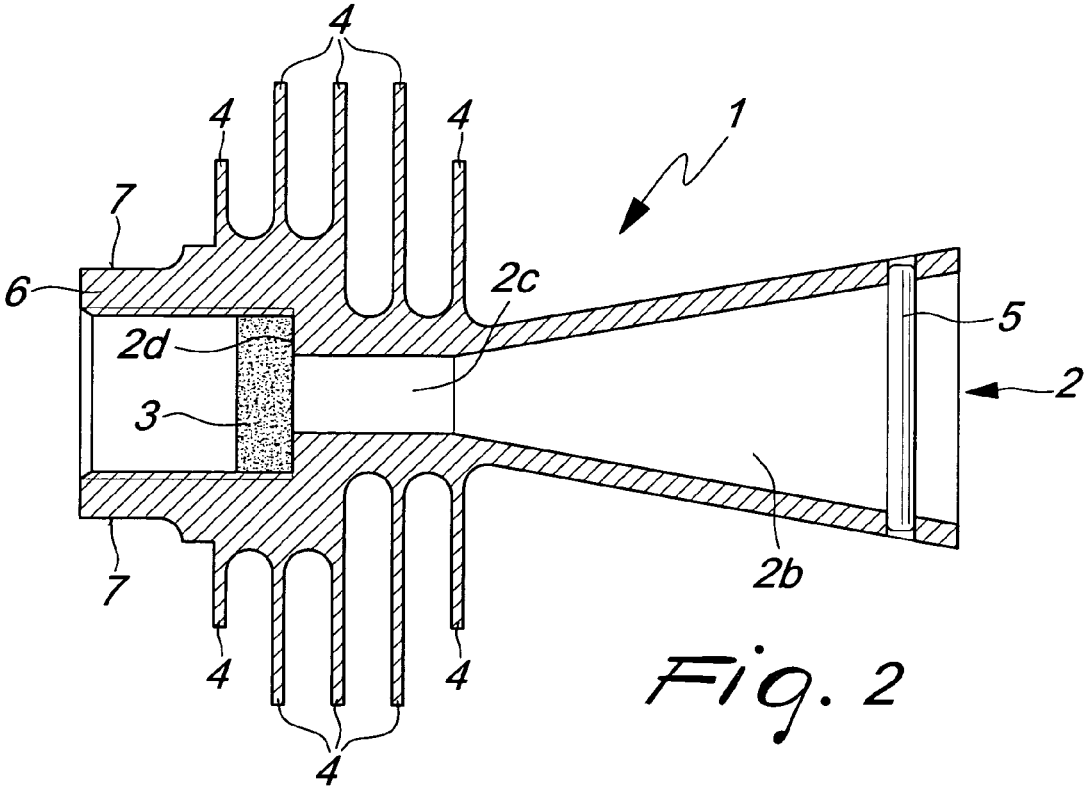
FIG. 2 is a sectional side elevation view of a second embodiment of a nozzle for extinguishing devices and the like according to the invention.
Figure 3:
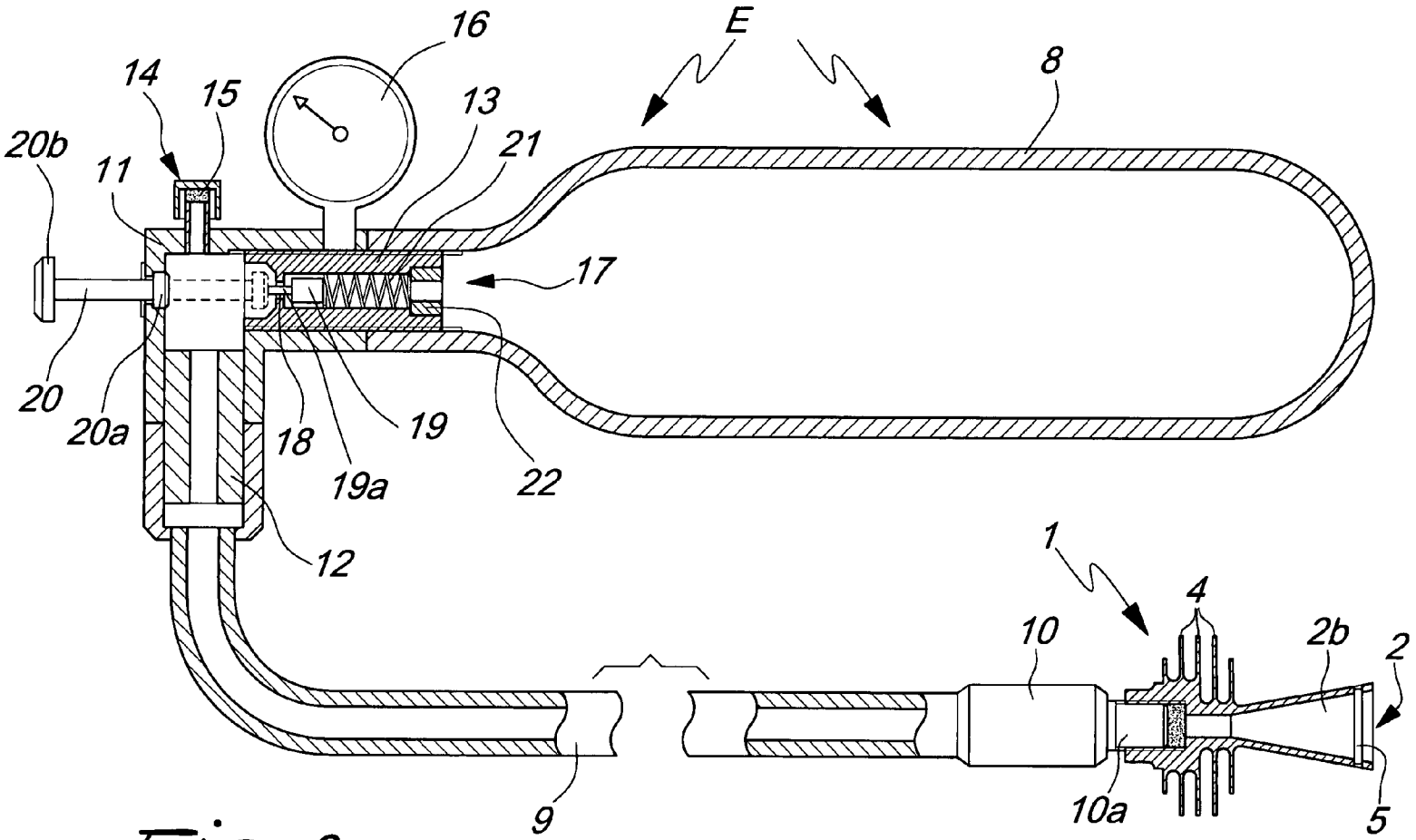
FIG. 3 is a sectional side elevation view of the nozzle of FIG. 2, associated with an extinguisher of the type that comprises a tank for the extinguishing agent.

In a second embodiment, which can allow faster insertion of the pad 3, the opening 2 of the nozzle 1 comprises at least a straight part 2*c* and a diverging part 2*b*, which are arranged respectively along the direction of expulsion of the extinguishing agent, the straight part 2*c* being closed hermetically by the pad 3 (as shown in FIGS. 2 and 3). In particular, the pad 3 is located in a receptacle 2*d*, which is arranged at the end of the straight part 2*c* and is formed inside the threaded hollow shank 6: the pad 3 has a substantially circular transverse cross-section whose diameter is substantially equal to the inside diameter of the thread of the shank 6. In this second embodiment, the grip portion 7 is provided on the outside of the shank 6.

The pad 3 can be conveniently provided separately and inserted rapidly within the receptacle 2*d* inside the shank 6; after this, the nozzle 1 is associated with the extinguishing device (of any type). Favorably, with said extinguishing device in the active configuration, the pressure applied by the extinguishing agent helps to keep the pad 3 pressed so as to close hermetically the straight part.

In FIG. 3, the nozzle 1, as mentioned, is associated with an extinguisher E, which comprises a tank 8 which contains the extinguishing agent, and in particular the nozzle 1 is associated with a flexible hose 9 of the extinguisher E, so that it can be positioned in the points of the controlled environment where it is presumed that a fire may start.

Effectively, the extinguisher E can be provided with a plurality of flexible tubes or hoses 9, each associated with a respective nozzle 1, so as to control several points deemed critical for the possible starting of a fire.

Each nozzle 1 is associated with the flexible hose 9 by means of a terminal connecting sleeve 10, and in particular the terminal shank 6 of the nozzle 1 is hollow and threaded for fastening in a corresponding threaded terminal outlet 10*a* of the sleeve 10.

The terminal outlet 10*a* also helps to keep the pad 3 pressed so as to close hermetically the straight portion (or, in the case of the first embodiment of the nozzle 1, pressed against the walls of the converging portion 4*a*).

The sleeve 10 is adequately made of a material with a high heat conduction coefficient for optimum transmission of the heat to the nozzle 1.

As shown in FIG. 3, the extinguisher E comprises a connecting element 11, which is associated in an upper region with respect to the tank 8 and is provided with at least one threaded coupling 12 for the connection of a respective flexible hose 9, or with a plurality of couplings 12 for the connection of a corresponding number of flexible hoses 9 for controlling, as mentioned, a larger number of critical points.

Conveniently, a bush 13 is provided for connecting the tank 8 and the connecting element 11 and is threaded externally for fastening in a corresponding internally threaded inlet of the tank 8 and in a corresponding internally threaded end of the connecting element 11.

A safety device is associated with the connecting element 11 and is adapted to expel automatically the extinguishing agent if the tank 8 accidentally overheats.

Such safety device comprises a cap 14, which is provided with a diaphragm 15 which breaks automatically at a preset pressure.

Advantageously, there is also a monitoring pressure gage 16 for checking the internal pressure of the extinguishing agent contained in the tank 8. The extinguisher E comprises a valve 17 with controlled closure for controlling the flow of the extinguishing agent between the tank 8 and the connecting element 11, said valve being provided within the cavity of the bush 13.

The bush 13 forms, proximate to a first end thereof, a port 18 for the passage of the extinguishing agent, and there is a flow control element 19, which is accommodated slidingly within the bush 13 and kept elastically in the configuration for closing hermetically the port 18, and a stem 20 for opening the port 18, which is accommodated so that it can slide hermetically in the connecting element 11.

In particular, the flow control element 19 is provided in an upper region with a sealing O-ring (not shown in the figures) and is pushed by a spring 21 which abuts, at its other end, against a threaded bushing 22, which is fastened to the other end of the bush 13; the stem 20 is coaxial to the flow control element 19 and is provided with an internal head 20*a* for abutment against a tab 19*a* of the flow control element 19 which protrudes from the port 18 for opening it, and with a grip head 20*b* which protrudes from the connecting element 11 for the manually-controlled opening of the valve 17.

In practical operation, in the case of the extinguisher E, the nozzle or nozzles 1 are positioned quickly and easily in the points deemed critical of the environment to be controlled by means of the flexible hoses 9, which therefore allow to arrange conveniently the tank 8 also outside the environment.

The environment to be controlled can be for example the inside of an engine compartment or of another confined volume.

If a fire occurs, the temperature variation of the controlled environment is transmitted rapidly to the nozzle 1 by the fins 4, and once a preset temperature has been reached, the pad 3 of thermoplastic material softens and is expelled automatically through the opening 2 by the pressure of the extinguishing agent, which by escaping and flooding the controlled environment allows to extinguish the fire.

The pin 5, when provided, blocks the pad 3 at the exit from the opening 2, preventing its violent expulsion at high speed, if this intervention is deemed appropriate.

In particular, the temperature at which the pad 3 softens is determined by the manufacturer according to requirements, choosing conveniently a low-melting plastic material with a different softening temperature depending on the expectations of the fire load and of its increase over time.

Again if the nozzle 1 is associated with the extinguisher E, the tank 8 has a capacity which is proportional to the number of hoses 9 and corresponding nozzles 1, and if the applicable standards require its installation, the safety cap 14 allows the expulsion of the extinguishing agent from the diaphragm 15 once a preset safety pressure has been reached.

Advantageously, it is possible to install on the valve 17 a pressure gage 16, which allows the user to check the filling of the tank 8 during the loading of the extinguishing agent and to check subsequently whether the tank 8 has been emptied, for example due to the activation of the extinguisher E due to a fire.

If the extinguisher E, and in general the extinguishing device, has actually been activated to extinguish a fire, the nozzles 1 can be restored easily and quickly in a suitable workshop by performing sequentially simple and inexpensive maintenance operations, such as the removal of the nozzles 1, the application of a new pad 3, and the refitting of said nozzles (facilitated by the presence of the contoured portion 7). Also in the case of the extinguisher E, the sequence of the operations for maintaining and restoring said extinguisher is: removing the nozzles 1 and the flexible hoses 7 from the couplings 12; replacing the pad 3; refastening the nozzle 1 to the sleeve 10; filling the tank 8 by means of the coupling 12 while the valve 17 is opened; closing the valve 17 (by acting on the stem 20), connecting the hose 9 to the coupling 12, and finally opening the valve 17, so as to bring the extinguisher E to the configuration for use.

Positively, the nozzle 1 can be associated with any extinguishing device, not only for engine compartment or confined volumes, but also for other volumes, adapting in this case the capacity of the tank 8 as well as the number of nozzles 1 and the length of the hoses 9.

In practice it has been found that the invention fully achieves the intended aim and objects, since the nozzle 1 allows automatic dispensing of the extinguishing agent by way of the pad 3, which can be removed automatically at a preset temperature, due to the action of the pressure of said extinguishing agent, thus ensuring maximum effectiveness. Further, the nozzle 1 is simple to maintain and restore, with advantages also from an economic standpoint.

The invention thus conceived is susceptible of numerous modifications and variations, all of which are within the scope of the appended claims; all the details may further be replaced with other technically equivalent ones.

In the exemplary embodiments shown, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

In practice, the materials used, as well as the shapes and the dimensions, may be any according to requirements and to the state of the art without thereby abandoning the scope of the protection of the appended claims.

The disclosures in Italian Patent Application No. BO2005A000535 from which this application claims priority are incorporated herein by reference.

What is claimed is:

1. A nozzle in association with an extinguishing device containing a gas extinguishing agent under pressure, said nozzle comprising:

a body portion of a material with a high heat conductivity coefficient and comprising at least one through opening, wherein said opening comprises at least one straight part of larger diameter that leads to a straight part of a smaller diameter, which in turn leads to at least one diverging part, which parts are arranged in that order respectively along the direction of expulsion of the extinguishing agent, said through opening being further adapted to be coupled to a tank of said extinguishing device which tank contains said extinguishing agent;

at least one pad made of thermoplastic material, said pad having a substantially circular transverse cross section that is equal to the inside diameter of the straight part of larger diameter, and being held in place by being seated singularly in the straight part of said larger diameter against said straight part of smaller diameter such that the pad hermetically blocks said through opening and is held in place by pressure of said the extinguishing agent retaining the pad against the straight part of smaller diameter; and a heat conduction assembly including a plurality of fins that are distributed peripherally on an exterior of at least one of: said body portion and said straight portion such that during fire fighting conditions, the temperature variation is transmitted rapidly to said body portion by said fins, and in turn to said pad which is adapted to soften at a preset temperature and is automatically expelled out of the through opening due to the pressure of the extinguishing agent, thereby allowing the automatic dispensing of said extinguishing agent via the through opening, after which the pad is adapted to be quickly restored.

2. The nozzle of claim 1, wherein said pad is disposed in a receptacle arranged at the end of said straight part of larger diameter.

3. The nozzle of claim 2, comprising a terminal shank for coupling to outlets of the extinguishing devices.

4. The nozzle of claim 2, further comprising a flexible hose of an extinguisher for suitable placement in the environment controlled by said extinguisher, said extinguisher comprising at least said flexible hose connected to said tank which contains the extinguishing agent.

5. The nozzle of claim 4, comprising a threaded hollow terminal shank for fastening in a corresponding threaded terminal outlet of a sleeve for connection to said flexible hose.

6. The nozzle of claim 5, wherein a receptacle for said pad is formed inside said shank.

7. The nozzle of claim 6, wherein said receptacle for said pad is formed inside said threaded hollow shank, said pad having a transverse cross-section which is substantially circular and has a diameter which is substantially equal to the inside diameter of the thread, and said diameter being greater than the diameter of the adjacent orifice, being the straight part of smaller diameter of the through opening.

8. The nozzle of claim 1, being of the De Laval type, said opening comprising at least one converging part and at least one diverging part, which are distributed respectively along the direction of expulsion of the extinguishing agent, at least one portion of said converging part being block hermetically by said pad, whose shape is substantially complementary to the shape of said converging part.

9. The nozzle of claim 1, comprising heat conduction means for optimum heat transmission.

10. The nozzle of claim 9, wherein said pad is substantially comprised of a low melting plastic material that softens at a preset temperature.

11. The nozzle of claim 1, comprising a substantially transverse safety element arranged proximate to said opening and adapted to prevent the violent expulsion of said pad.

12. The nozzle of claim 11, wherein said safety element is a pin, which is inserted detachably in at least one respective hole of said nozzle, said pin being arranged transversely in a diverging part of said opening.

13. The nozzle of claim 1, comprising a contoured portion which is adapted to be gripped by a tool, so as to allow optimum fastening to outlets of the extinguishing devices.

14. An extinguishing device, comprising:

a tank containing extinguishing agent, said tank being capable of being handheld;

a hose coupled to said tank at one end; and a nozzle substantially made of a material with a high heat conductivity coefficient having a through opening with at least one straight part of larger diameter that leads to a straight part of a smaller diameter leading to at least one diverging part, which parts are arranged respectively along the direction of expulsion of the extinguishing agent, said through opening being configured to affix said nozzle to said containing extinguishing agent;

at least one pad made of thermoplastic material, said pad having a substantially circular transverse cross section and being singularly disposed in the through opening, said pad held in place by being seated in the straight part of said larger diameter against said straight part of smaller diameter such that the pad hermetically blocks said through opening and said pad is held in place solely by pressure of said extinguishing agent retaining the pad against straight part of smaller diameter such that after activation of the extinguishing device, the pad is adapted to be quickly restored; and a plurality of fins distributed peripherally on an exterior of said body portion such that during fire fighting conditions, the temperature variation is transmitted rapidly to said body portion by said fins, and in turn to said pad which is adapted to soften at a preset temperature and softened is automatically expelled through the opening due to the pressure of the extinguishing agent, allowing the automatic dispensing of said extinguishing agent through the opening.

15. The extinguishing device as defined in claim 14 further comprising a connecting assembly for coupling said tank to said hose, said connecting assembly including an externally threaded bush that is fastened between a corresponding internally threaded inlet of the tank and a correspondingly internally threaded end of a connecting element that is coupled to said hose.

16. The extinguishing device as defined in claim 15 further comprising a safety device associated with the connecting element adapted to expel automatically the extinguishing agent if the tank accidentally overheats.

17. The extinguishing device as defined in claim 16 wherein said safety device comprises a cap which is provided with a diaphragm that breaks at a predetermined temperature to allow said extinguishing agent to escape.

18. The extinguishing device as defined in claim 14 further comprising a terminal connecting sleeve that couples the end of the hose to a terminal outlet which is formed at one end of the nozzle, said terminal outlet having a diameter that is greater than the diameter of said straight portion of said through opening.

19. The extinguishing device as defined in claim 18 wherein said pad has substantially the same diameter as the terminal outlet, and said pad is pressed against the end of the terminal outlet against the straight portion to thereby hermetically seal the straight portion.

20. The extinguishing device of claim 19 wherein said tank and said hose are filled with said extinguishing agent such that the extinguishing agent holds the pad in place in the terminal outlet, and at the preset temperature, the pad dislodges and the extinguishing agent automatically flows through said through opening substantially immediately.

21. The extinguishing device of claim 14 wherein said pad is disposed internally within said through opening.

* * * * *